United States Patent [19]

Deborde

[11] 4,102,363

[45] Jul. 25, 1978

[54] NEEDLES FOR SHUTTLE-LESS LOOMS

[75] Inventor: Albert Henri Deborde, Bourgoin-Jallieu, France

[73] Assignee: Saurer Diederichs (Societe Anonyme), Bourgoin-Jallieu, France

[21] Appl. No.: 743,521

[22] Filed: Nov. 19, 1976

[30] Foreign Application Priority Data

Feb. 10, 1976 [FR] France ..... 76 04369

[51] Int. Cl.[2] ..... D03D 47/18

[52] U.S. Cl. ..... 139/449; 139/441; 139/446

[58] Field of Search ..... 139/440, 441, 443, 444, 139/445, 446, 447, 448–449; 428/367, 902, 110

[56] References Cited

U.S. PATENT DOCUMENTS

| | | | |
|---|---|---|---|
| 3,580,291 | 5/1971 | Piccoli | 139/448 |
| 3,669,566 | 6/1972 | Bourguardez et al. | 429/902 |
| 3,681,187 | 8/1972 | Bowen et al. | 428/902 |
| 3,789,887 | 2/1974 | Peter | 139/449 |
| 3,936,336 | 2/1976 | Philips | 428/367 |
| 4,023,801 | 5/1977 | Van Auken | 428/110 |

*Primary Examiner*—Henry S. Jaudon
*Attorney, Agent, or Firm*—Karl F. Ross

[57] ABSTRACT

A weft-laying needle for a shuttle-less loom has a U-shaped cross section with a relatively thick web and a pair of thinner shanks. The needle is composed of a body of synthetic-resin impregnated carbon fibers in which a woven glass fiber layer is inlaid below the outer surface and inwardly of the inner surface over the shanks and web at uniform distances from these surfaces.

2 Claims, 4 Drawing Figures

NEEDLES FOR SHUTTLE-LESS LOOMS

FIELD OF THE INVENTION

The present invention relates to needles for shuttle-less looms.

BACKGROUND OF THE INVENTION

Shuttle-less looms have been provided in which the weft is deposited in the shed by means of two "needles" or "lances" carrying out inverse alternating rectilinear movements such that:

when the needles approach each other, the needle carrying the weft yarn brings it to the center of the shed where the yarn is transferred from one needle to the other;

during the withdrawal movement of said needles, i.e. when they leave the shed, the needle which has just received the yarn, completes laying in the weft.

Although this system of inserting the weft may be advantageous, in practice it is suitable solely for weaving narrow or relatively narrow webs.

This is why, for the purpose of producing wide webs while at the same time limiting the bulk of the machine, devices with telescopic needles are used, comprising an outer member in which an inner member is slidably mounted.

To produce these members of the telescopic needles, it is already known to use metal parts having a U-shaped cross section, whose rigidity should be the as great as possible in order to ensure that the two needles meet in a very accurate manner. Furthermore, these shaped parts sliding one in the other at very high speed should have contact surfaces with a very low coefficient of friction, as well as a sufficiently low mass to limit the stress in the devices for controlling the needles. To this end, parts made from aluminum are currently used.

SUMMARY OF THE INVENTION

The object of the present invention is to improve upon such needles or at least one of their parts in the case of telescopic needles, by choice of the constituent to obtain greater rigidity than the metals normally used and also lower density to achieve higher operating speeds of the machines.

This object is obtained by providing at least one of the shaped parts forming the needle is made from a composite material based on carbon fibers and woven glass material, embedded in a bonding agent.

This material has a low density which limits the inertia of the needle member in question while having a high modulus of elasticity. The carbon fiber gives the latter these qualities provides a modulus of elasticity of approximately 15,000, which is virtually twice that of the aluminum used hitherto. The woven glass material constitutes a necessary reinforcement, since the carbon fiber alone, which is in the form of a nonwoven sheet, would have the drawback of not providing sufficient strength particularly at the corners.

For bonding the sheets, the bonding agent used is advantageously a synthetic resin.

According to a preferred embodiment of the invention, the U-shaped sectional member has a web which is thicker than its two sides and is reinforced by two layers of woven glass material which are, present both in the region of its web and its sides and follow the outer surface of its section and the inner surface of its section respectively, these two layers being located at a substantially constant distance from the respective surface and as close as possible to the latter, but without being visible.

These two layers of woven glass material reinforce the sides of the sectional member in particular and give them greater strength, which is necessary particularly in the regions where the grippers of the needles and the means for driving these needles are fixed. It is important that these layers are not exposed the surface of the sectional member, so as not to increase its coefficient of friction, which must remain low as explained above. Additional reinforcement is obtained by the thickness of the web which is greater than that of the sides of the sectional member.

SPECIFIC DESCRIPTION

Figure 1:
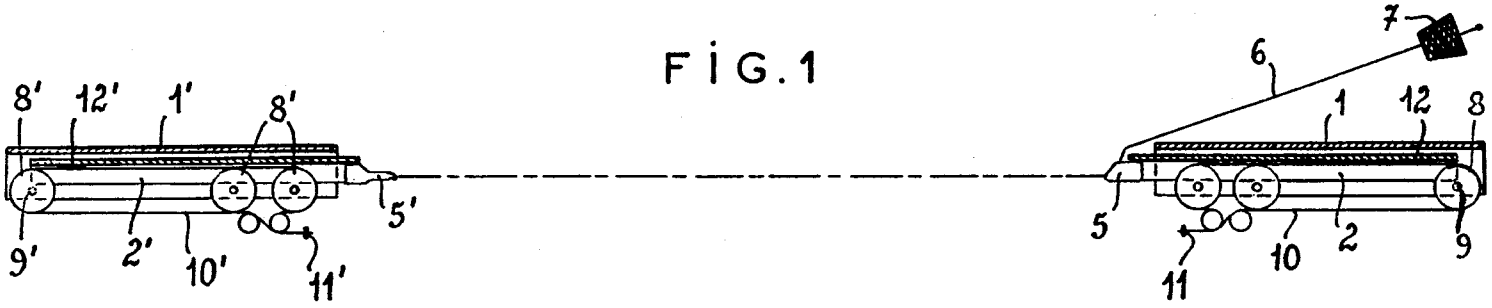
FIGS. 1 and 2 show the diagrammatically a system formed by two needles, in the retracted and extended positions respectively, in front view.
Figure 2:
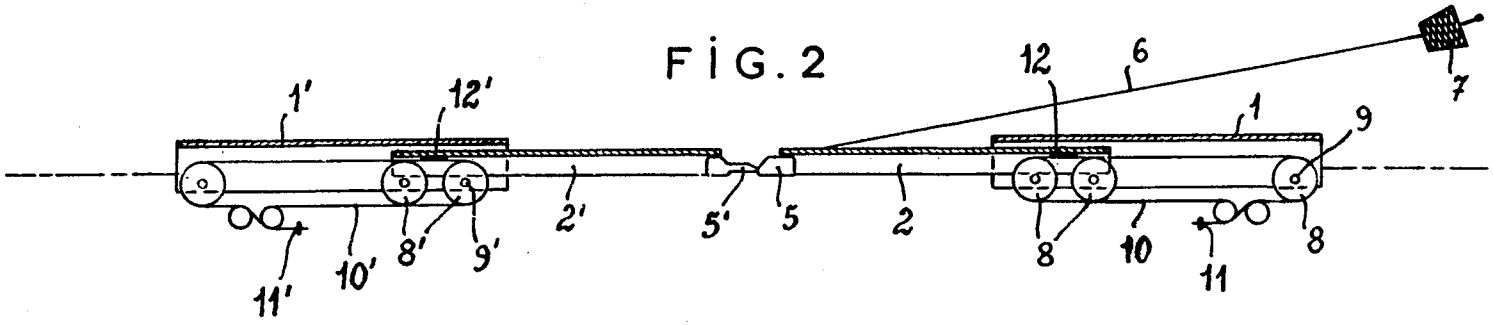

The loom illustrated in FIGS. 1 and 2, comprises two telescopic needles both formed by an outer member 1, 1' respectively and an inner member 2, 2' respectively sliding in the corresponding outer member. Each of these needle members 1, 1', 2, 2', has a U-shaped cross section and is in the form of a shaped part with two vertical sides 3 and 3' connected at their upper part by a horizontal web 4 (see FIG. 3). At the end of its inner member 2, the right-hand needle supports a gripper 5 which holds the weft yarn 6 unwinding from a bobbin 7 located on the side of the loom and which supplies it to the centre of the shed. At the end of its inner member 2', the left-hand needle comprises a gripper hook 5' which takes the weft yarn 6 from the gripper 5, by penetrating the latter (position shown in FIG. 2) in order to entrain the yarn during its return travel and to place the latter in the second half of the shed.

The inverse alternating movements of the two needles are controlled by known means:

The outer members 1 and 1' are driven in an alternating rectilinear movement by a connecting rod - crank - lever system (not shown). During their movement, the outer members 1 and 1' drive several rollers, 8, 8' respectively whose shafts 9, 9' are supported by the sides of the corresponding members.

A belt 10, 10' respectively passing over these rollers is attached on the one hand, by its two connected ends, at a fixed point 11 or 11' of the machine frame and on the other hand at a point 12 or 12' located at the rear of each inner member 2 or 2'. Thus, when an outer needle member 1 or 1' is displaced, the point 12 or 12' which is connected thereto by means of the belt 10 or 10', thus the corresponding inner needle member 2 or 2', has a speed which is twice that of the outer member and in the same direction with respect to a fixed reference, which makes it possible to extend and alternately retract the needle.

Figure 3:
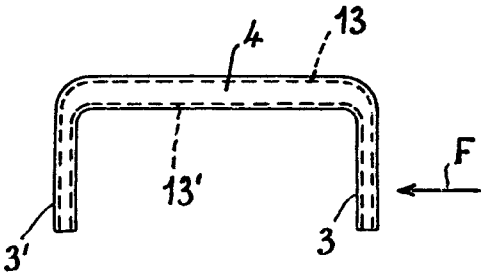
FIG. 3 shows diagrammatically the U-shaped section of one of the parts of each needle, to an enlarged scale.
Figure 4:
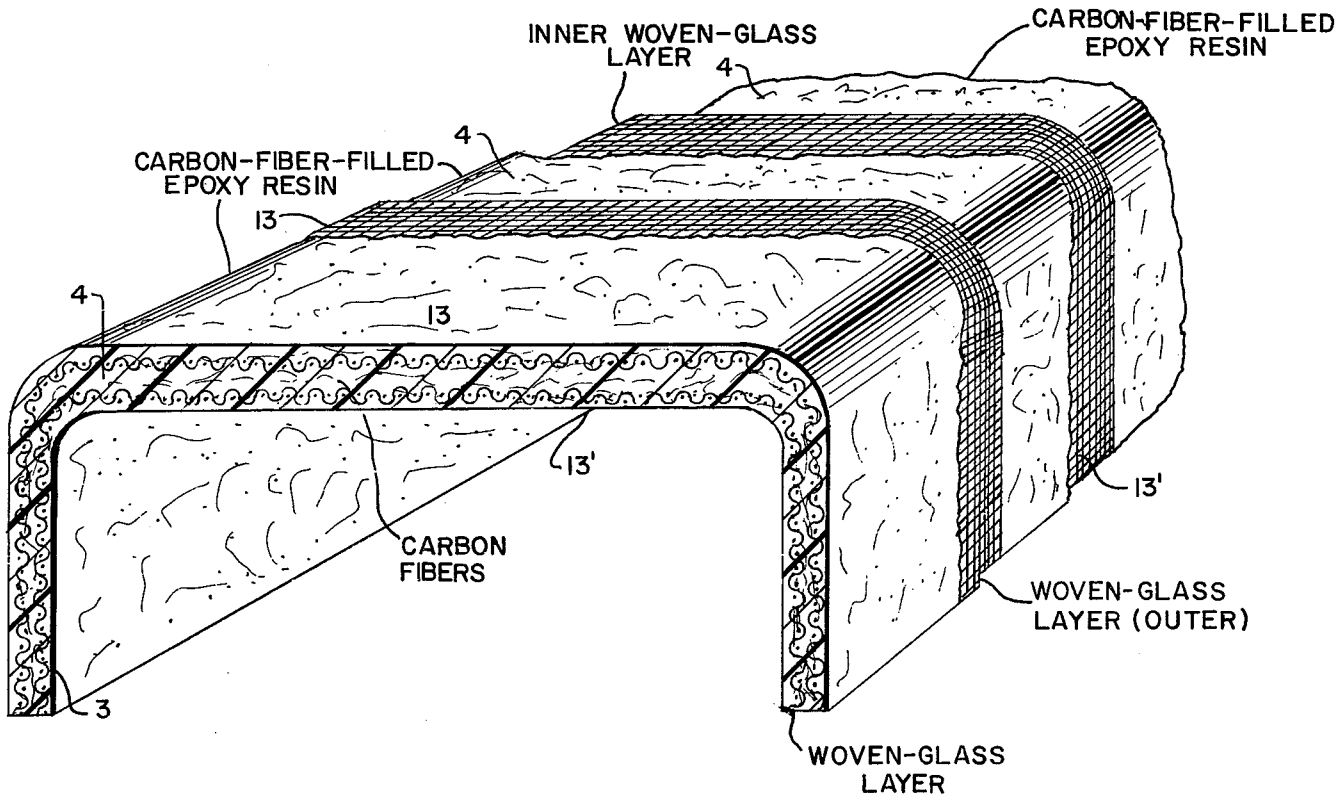
FIG. 4 is a perspective view having cut away portions of the U-shaped section.

The invention relates to the construction of the sectional parts constituting the needle members 1, 1', 2, 2' and is illustrated in FIG. 3.

The sides 3 and 3' of these sectional members, as well as their web, the thickness of which is greater than that of the said sides, are made from a composite material based on carbon fibers having a high modulus of elasticity. A reinforcement for these carbon fibers is obtained by incorporating two layers of woven glass material 13 and 13', the arrangement of which is as follows: the first layer 13 follows the outer surface of the section of the shaped part, both in the region of its sides 3 and 3' and in the region of its web 4. The second layer 13' follows the inner surface of the section of the shaped part and it is also present, both on the sides and web. These two layers of woven glass material 13 and 13' are located at the same distance from the respective surface, as close as possible to the latter, but so as not to be visible (exposed).

The various sheets are interconnected by an epoxy resin.

The reinforcement obtained by the incorporation of two layers 13 and 13' increases the strength of the sides 3 and 3', in particular in the case where a lateral force F is exerted, owing to the resistance to elongation of the "outer" layer 13 and the crushing strength of the "inner" layer 13'. This reinforcement is particularly useful for the outer needle members 1 and 1', in the regions of the sides where the shafts 9, 9' for the respective rollers 8, 8' are fixed and for the inner needle members 2 and 2', at the end supporting the gripper 5 or hook 5'.

The carbon fiber confers greater rigidity on the parts of the two needles and thus ensures that the gripper 5 and hook 5' approach each other with great accuracy in the position of FIG. 2.

Naturally, the invention is not limited to the single embodiment of these needle parts which has been described above as an example, in the case of a particular and non-limiting application. On the contrary, it includes all variations comprising an equivalent structure.

I claim:

1. A needle for the laying of a weft in the shed of a shutter-less loom comprising an elongated U-cross section body of carbon fibers impregnated with a synthetic resin, said body having a web and a pair of shanks extending transversely to said web, said web having a thickness greater than that of said shanks, and a pair of woven glass fiber layers imbedded in said synthetic resin and extending over said shanks and said web, one of said glass fiber layers lying as close as possible to the outer surface of said body, the other of said glass fiber layers lying as close as possible to the inner surface of said body, each of said glass fiber layers being spaced inwardly of the respective surface by substantially constant distances.

2. The needle defined in claim 1 wherein said synthetic-resin is an epoxy resin.

* * * * *